US007503170B2

(12) United States Patent
Dubots et al.

(10) Patent No.: US 7,503,170 B2
(45) Date of Patent: Mar. 17, 2009

(54) STRUCTURE FOR FILTERING AN INTERNAL ENGINE EXHAUST GASES AND ASSOCIATED EXHAUST LINE

(75) Inventors: Dominique Dubots, Sallanches (FR); Nicolas Bonnail, Avignon (FR)

(73) Assignee: Saint-Gobain Centre de Recherches et d'Etudes Europeen, Courbevoie (FR)

( * ) Notice: Subject to any disclaimer, the term of this patent is extended or adjusted under 35 U.S.C. 154(b) by 15 days.

(21) Appl. No.: 11/577,252

(22) PCT Filed: Oct. 11, 2005

(86) PCT No.: PCT/FR2005/002517

§ 371 (c)(1),
(2), (4) Date: Aug. 9, 2007

(87) PCT Pub. No.: WO2006/040474

PCT Pub. Date: Apr. 20, 2006

(65) Prior Publication Data

US 2007/0277516 A1 Dec. 6, 2007

(30) Foreign Application Priority Data

Oct. 14, 2004 (FR) ..... 04 10872

(51) Int. Cl.
*F01N 3/00* (2006.01)

(52) U.S. Cl. ..... 60/297; 60/287; 60/288; 60/292; 60/295; 60/296; 60/311; 60/324; 55/302; 55/DIG. 30

(58) Field of Classification Search ..... 60/287, 60/288, 291, 292, 295, 296, 297, 311, 313, 60/324; 55/302, DIG. 30
See application file for complete search history.

(56) References Cited

U.S. PATENT DOCUMENTS

| | | | | |
|---|---|---|---|---|
| 4,584,003 | A * | 4/1986 | Oda et al. | 55/315.2 |
| 4,833,883 | A * | 5/1989 | Oda et al. | 60/311 |
| 5,019,142 | A | 5/1991 | Waschkuttis | |
| 5,853,438 | A * | 12/1998 | Igarashi | 55/302 |
| 6,375,695 | B2 * | 4/2002 | Machida et al. | 55/282.3 |
| 6,471,918 | B1 * | 10/2002 | Sherwood | 422/171 |
| 6,989,045 | B2 * | 1/2006 | Bailey et al. | 95/129 |

FOREIGN PATENT DOCUMENTS

| | | |
|---|---|---|
| DE | 199 10 258 A1 | 9/2000 |
| DE | 103 30 680 A1 | 7/2004 |
| EP | 1 408 208 A1 | 10/2003 |
| EP | 1 435 436 A1 | 7/2004 |
| FR | 2 816 002 A1 | 5/2002 |

* cited by examiner

*Primary Examiner*—Binh Q. Tran
(74) *Attorney, Agent, or Firm*—Sughrue Mion, PLLC

(57) ABSTRACT

The invention concerns a structure (11) comprising a filtering member (21) comprising intake conduits (35) for the gases to be filtered, and conduits (37) for extracting the filtered gases, separated from the intake conduits (35) by porous filtering walls (43). The intake conduits (35) emerge into openings (49) for discharging respective residues, provided downstream of the respective intake openings (47). The openings discharging residues (49) of the intake conduits (35) open into a common manifold (25) for receiving solid filtering residues, forming counter-pressure means for the intake conduits (35). Said manifold (25) is isolated from the extracting conduits (37). The invention is applicable to particulate filters for exhaust gases of a motor vehicle diesel engine.

11 Claims, 6 Drawing Sheets

STRUCTURE FOR FILTERING AN INTERNAL ENGINE EXHAUST GASES AND ASSOCIATED EXHAUST LINE

BACKGROUND OF THE INVENTION

The present invention relates to a structure for filtering the exhaust gases from an internal-combustion engine, of the type comprising at least one filtering member comprising:

- intake conduits for the gases to be filtered, into which respective gas intake openings emerge, at least some of the intake conduits emerging through openings for discharging respective residues provided downstream of the respective intake openings;
- conduits for extracting filtered gases emerging into respective openings for extracting filtered gases, the extracting conduits being separated from the intake conduits by porous filtering walls.

Structures of this type are used, in particular, in devices for controlling de-pollution of exhaust gases from motor vehicle diesel engines.

Filtering structures are known in which the filtering member comprises a set of adjacent conduits having parallel axes, separated by porous filtering walls. The conduits extend between an intake face and a discharge face. These conduits are closed at one or other of their ends to delimit gas intake conduits opening onto the intake face, and gas extracting conduits opening onto the discharge face.

The structures of the aforementioned type operate in accordance with a sequence of filtering phases and regeneration phases. During the filtering phases, the soot particles emitted by the engine are deposited on the walls of the inlet chambers. The loss in pressure through the filter increases gradually. Beyond a predetermined value of this pressure loss, a regeneration phase is carried out.

During the regeneration phase, the soot particles, basically composed of carbon, are burnt on the walls of the inlet chambers in order to restore the original properties of the structure.

However, the residues resulting from the burning of the soot accumulate in the base of the intake conduits. The initial loss in pressure through the structure therefore increases after each regeneration phase, and the distance covered between the regeneration phases decreases over the vehicle's life.

In order to overcome this problem, EP-A-1 408 207 discloses a structure of the aforementioned type in which slots for discharging residues are formed in the porous walls separating the intake conduits from the extracting conduits, in the vicinity of the discharge face.

At the start of a filtering phase, the soot preferably accumulates in the residue discharge slots and gradually blocks these slots to generate a counter-pressure in the intake chambers. During the regeneration phases, the residues from the burning of the soot flow into the extracting conduits through the slots and are discharged from the filtering member, then into the exhaust line.

A structure of this type is not entirely satisfactory. At the start of each filtering phase, a portion of the soot present in the intake gases passes through the filtering member without being filtered. Similarly, the combustion residues are discharged into the exhaust line during the regeneration phases. Then, even if the average effectiveness of the structure of the aforementioned type is improved, there remain phases for which this effectiveness is of less high quality.

A similar criticism can be made of the filtering structures of the aforementioned type described in documents EP-A-1 408 208 and EP-A-1 413 356.

SUMMARY OF THE INVENTION

An object of the invention is therefore to provide a structure for filtering the exhaust gases from an internal-combustion engine that has an improved service life while at the same time maintaining a substantially constant filtering effectiveness over time.

The invention accordingly relates to a filtering structure of the aforementioned type, characterized in that the discharge openings of at least one group of intake conduits open into at least one common manifold for receiving solid filtered residues forming counter-pressure means for said group of intake conduits, this manifold being isolated from the extracting conduits.

The filtering structure can comprise one or more of the following features, taken in isolation or in any technically possible combination:

- at least some openings for extracting filtered gases emerge transversely relative to the filtering member,
- at least some residue discharge openings emerge transversely relative to the filtering member,
- the filtering member comprises rows of adjacent intake conduits and rows of adjacent extracting conduits,
- at least some of the openings for extracting filtered gases extend in the vicinity of the downstream face of the filtering member,
- the discharge conduits emerge into secondary openings for extracting filtered gases that extend in a median portion of the filtering member,
- the intake conduits and the extracting conduits have an elongate cross-section in the transverse direction of the filtering member,
- the manifold comprises adjustable exhaust means,
- the exhaust means comprise a conduit connecting to the outlet of the exhaust line, the conduit being closed by an adjustable valve,
- the manifold comprises means for initiating the burning of soot; and
- the manifold comprises means for draining the collected residues.

The invention also relates to a motor vehicle exhaust line, characterized in that it comprises a filtering structure as defined hereinbefore.

BRIEF DESCRIPTION OF THE DRAWINGS

Embodiments of the invention will now be described with reference to the appended drawings, in which.

DETAILED DESCRIPTION OF TUE INVENTION.

Figure 1:
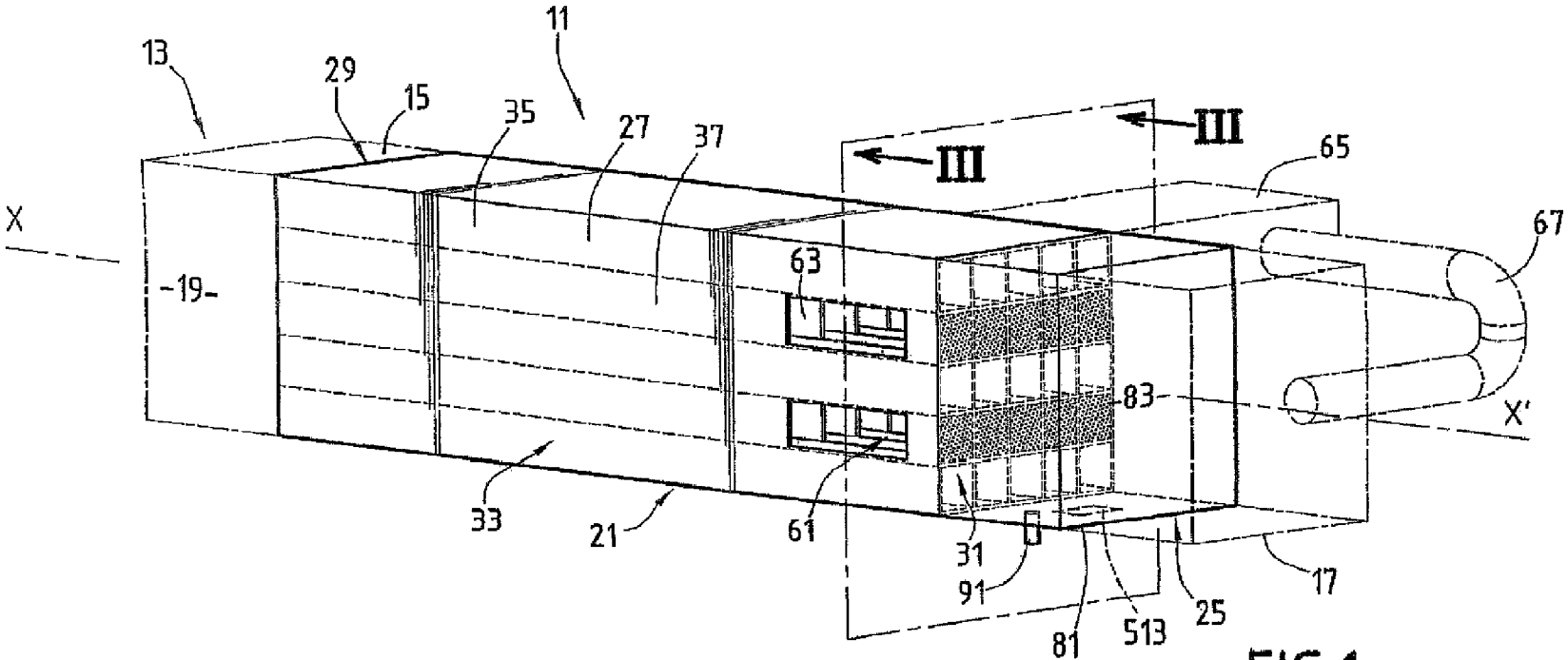
FIG. 1 is a perspective view of a first structure according to the invention.
Figure 2:
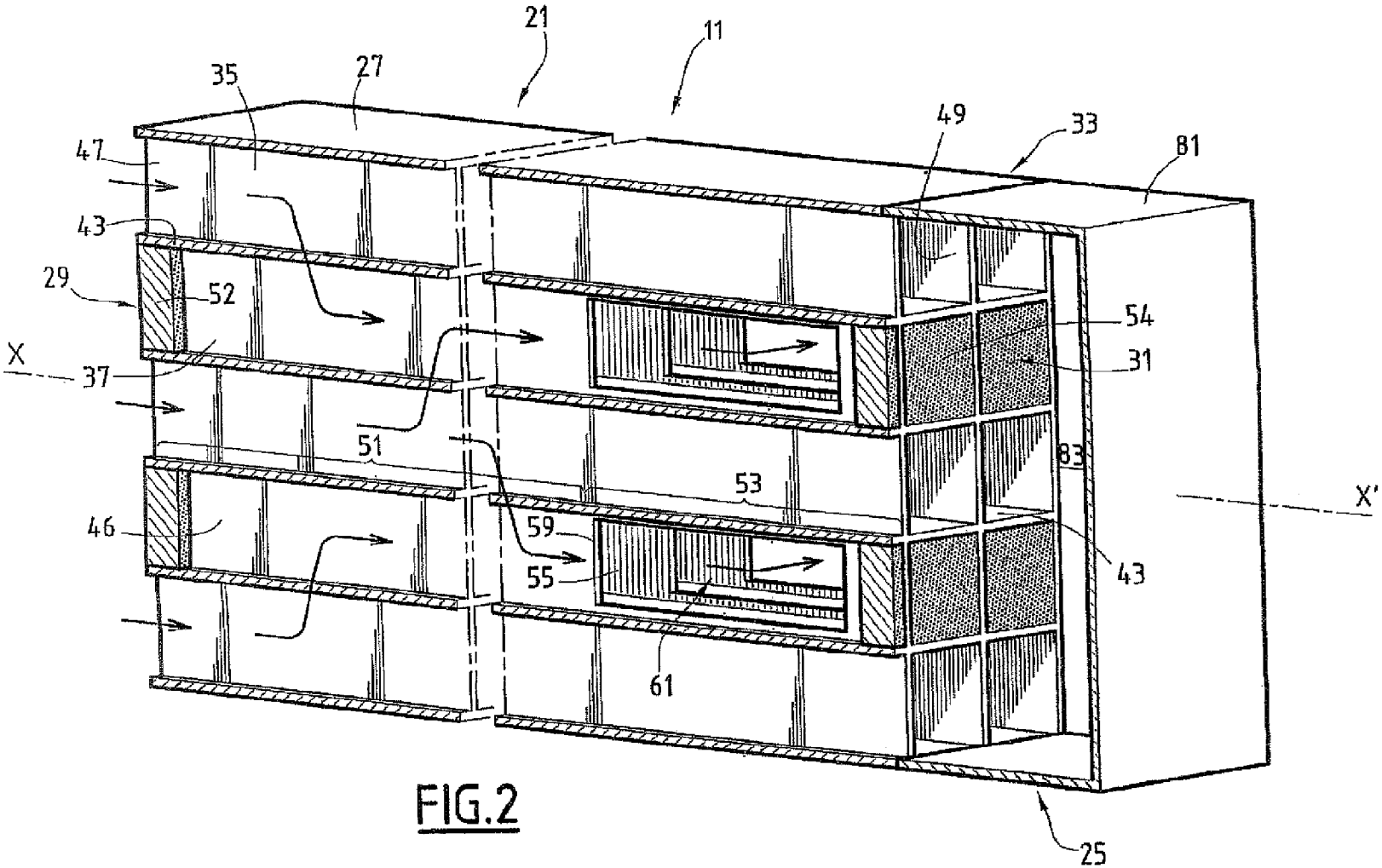
FIG. 2 is an enlarged partial view of FIG. 1 with partial tearing along a median vertical plane.
Figure 3:
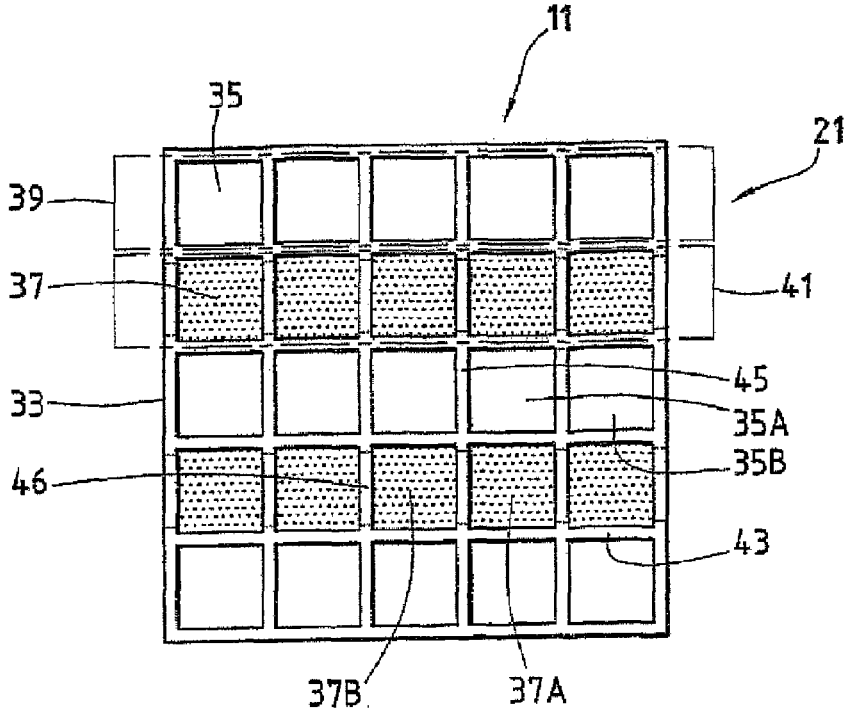
FIG. 3 is a cross-section along the vertical plane III-III of FIG. 1.

The filtering structure 11 shown in FIG. 1 to 3 is arranged in a line 13 for discharging the gases from a motor vehicle diesel engine, shown partially in FIG. 1.

This exhaust line 13 is extended beyond the ends of the structure 11 by an upstream intake diffuser 15 for the gases to be filtered, and by a downstream collector 17 for the filtered gases. The exhaust line 13 delimits a passage 19 for the circulation of the exhaust gases.

The filtering structure 11 comprises a soot filtering unit 21 and a manifold 25 for receiving the combustion residues.

The filtering unit 21 is substantially in the form of a rectangular parallelepiped extended parallel to a longitudinal axis X-X'.

As shown in FIG. 2, the filtering block 21 comprises a porous filtering framework 27, an intake face 29 for the exhaust gases to be filtered, a discharge face 31 and lateral faces 33.

The intake and discharge faces 29 and 31 are planar and substantially perpendicular to the axis X-X'.

The porous filtering framework 27 is made of a filtering material consisting of a one-piece structure, in particular of ceramics (cordierite or silicon carbide) or of metal.

This framework 27 is sufficiently porous to allow the exhaust gases to pass. However, as is known per se, the pore diameter is chosen so as to be sufficiently small to allow retention of the soot particles contained in these gases.

As shown in FIG. 2, the porous framework 27 defines a set of adjacent conduits having axes substantially parallel to the axis X-X'. The conduits are distributed into a first group of intake conduits 35 and a second group of extracting conduits 37.

As shown in FIG. 3, the intake conduits 35 and the extracting conduits 37 are grouped respectively into alternate rows 39 and 41, each intake conduit 35A being adjacent to at least one intake conduit 35B and to at least one extracting conduit 37A. In this example, the cross-section of the intake conduits 35 and the extracting conduits 37 is substantially square in shape. The rows 39 and 41 are shown to be horizontal.

The intake conduits 35A are separated from the adjacent extracting conduits 37A by porous filtering walls 43, which are horizontal in FIG. 3, and the adjacent intake conduits such as 35A and 35B are separated by structure walls 45, which are vertical in FIG. 3. Similarly, the adjacent extracting conduits such as 37A and 37B are separated by structure walls 46, which are vertical in FIG. 3.

The walls 43, 45, 46 are of constant thickness and extend longitudinally in the structure 11, from the intake face 29 to the discharge face 31.

With reference to FIG. 2, each intake conduit 35 extends continuously between a gas intake opening 47 in the intake face 29 and a residue discharge opening 49 which opens into the residue manifold 25, on the face 31. The walls 43, 45 delimiting the conduits 35 are continuous.

Each extracting conduit 37 comprises an upstream portion 51 and a downstream portion 53 which has lateral gas extraction passages 55 formed in the vertical walls 46, in the vicinity of the discharge face 31.

The upstream portion 51 extends between the intake face 29 and the upstream edge 59 of the passages 55. It is closed in the region of the intake face 29 by an end cap 52. The walls 43, 46 of the conduit 37 are continuous in the upstream portion 51.

The downstream portion 53 extends between the upstream portion 51 and the discharge face 31. It is closed in the region of the discharge face 31 by an end cap 54.

For each row 41 of adjacent conduits 37, the extracting passages 55 extend facing one another and define a transversely extending chamber 61 for collecting the filtered gases.

As shown in FIG. 1, the collecting chambers 61 emerge transversely into the vertical lateral faces 33 of the filtering unit 21, either side of this unit 21, through gas extracting openings 63 formed in these faces 33.

Lateral collectors 65, connected to the collector 17 by pipes 67, are fixed to the lateral faces 33 and tightly cover the extracting openings 63. FIG. 1 shows a single collector 65.

The chambers 61 are formed, for example, by ablation through the framework 27 by a laser beam.

With reference to FIG. 2, the residue manifold 25 is formed by a receptacle 81. This receptacle 81 is closed except for a collection opening which extends facing the entire discharge face 31.

The receptacle 81 tightly covers the intake face 31 and delimits a continuous internal volume 83 for collecting the combustion residues.

In this example, all the residue discharge openings 49 open into the internal volume 83. Moreover, the internal volume 83 is completely isolated from the extracting conduits 37 by the end caps 54.

The ratio between the internal volume 83 and the total volume of the intake conduits 35 is, for example, greater than 1. The receptacle 81 forms counter-pressure means for the intake conduits 35.

The functioning of the first structure 11 according to the invention will now be described.

During a filtering phase (FIG. 1), the exhaust gases, filled with soot particles, are guided in the diffuser 15 up to the intake face 29 of the filtering unit 21 by the exhaust line 13.

As indicated by arrows in FIG. 2, these gases then penetrate the intake conduits 35. As the residue manifold 25 forms counter-pressure means in these conduits 35, the exhaust gases pass for the most part through the porous walls 43 of the framework 27.

During this passage, the soot is deposited on the walls 43 in the intake conduits 35.

The filtered exhaust gases are then guided through the upstream portions 51, along the walls 43, then into the downstream portions 53 and collected in the chambers 61. They then flow toward the collector 17 of the exhaust line 13 through the openings 63 and the lateral collectors 65 in succession.

When the vehicle has traveled several hundred kilometres, for example 500 kilometres, the loss in pressure through the structure 11 increases significantly. A regeneration phase is then carried out, for example by a post-injection of fuel into the line 13, causing the temperature of the framework 27 to rise.

Burning of soot starts in the vicinity of the intake face 29 and then spreads toward the discharge face 31. The soot collected on the walls 43 is then transformed into combustion residues.

These combustion residues are entrained by the exhaust gases downstream of the unit 21 and migrate into the residue manifold 25 through the residue discharge openings 49.

The filtering walls 43 are thus cleared and the active filtering surface area of the unit 21 resumes substantially its initial state, i.e. there is found substantially the active surface area available before the start of the collection of the soot.

The service life of the filtering structure 11 accordingly no longer depends on the volume of the intake conduits 35 but results from the volume 83 of the residue manifold, which can be adjusted as a function of the desired service life.

The structure 11 according to the invention thus has the following advantages:

- the initial loss in pressure through the structure 11 is substantially recovered after each regeneration phase;
- the variation in the loss in pressure remains substantially constant throughout the service life of the structure,
- the distance traveled between the regeneration phases remains substantially constant, thus allowing the fuel consumption of the vehicle and the wear to the engine to be limited;
- the filtering effectiveness of the structure 11 is kept substantially constant over time.

This result is obtained by simple, inexpensive means, in particular without substantial modifications of the exhaust line 13.

In variation of this first structure 11, an igniter 91 can also be arranged in the base of the receptacle 81 in order to allow burning of the soot which migrates into the manifold 25 during the filtering phases. This igniter 91 is, for example, of the type described in French application FR-A-2 816 002.

Figure 4:
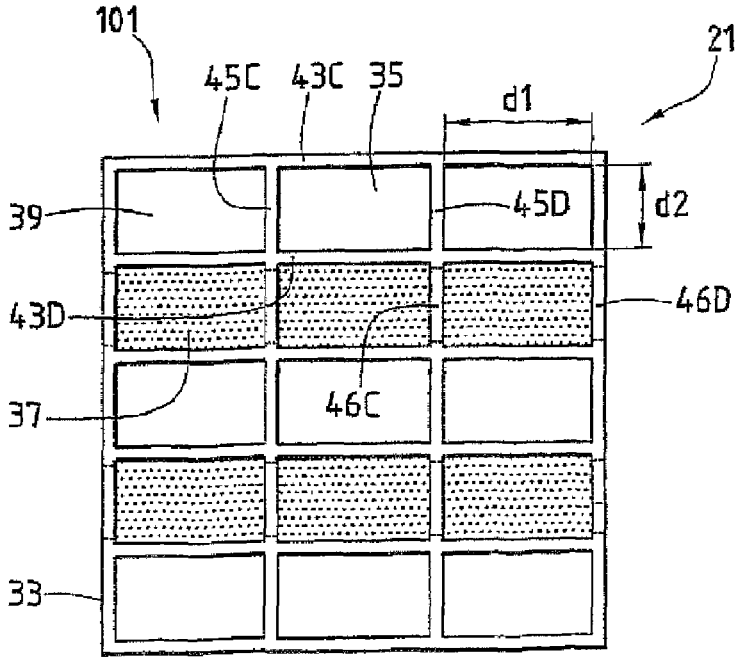
FIG. 4 is a view similar to FIG. 3 of a second filtering structure according to the invention.

The second structure according to the invention 101, shown in FIG. 4, differs from the preceding structure merely in terms of the fact that the intake conduits 35 and the extracting conduits 37 have cross-sections in the shape of a horizontally extended rectangle.

Thus, for each cross-section, the distance d1 separating the structure walls 45C, 45D or 46C, 46D from each conduit 35, 37 is greater than the distance d2 separating the porous walls 43C, 43D from each conduit 35, 37. The ratio d1/d2 between these distances is preferably greater than 1 and more preferably between 1 and 150, in order to maximize the active surface area of the filtering walls 43 while at the same time maintaining the mechanical properties of the unit 21.

Figure 5:
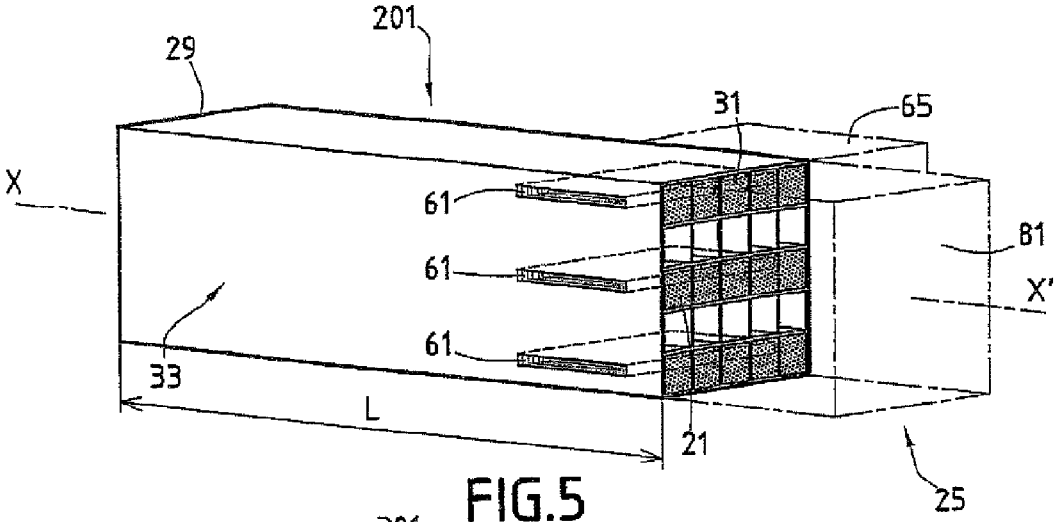
FIG. 5 is a partial view similar to FIG. 1 of the relevant portions of a third structure according to the invention.

The third filtering structure 201 shown in FIG. 5 comprises a plurality of juxtaposed filtering units 21 of the same length L, similar to those of the first structure 11, interconnected by connecting joints 203 arranged between the adjacent lateral faces of the units 21.

The intake faces 29 of the units 21, on the one hand, and the discharge faces 31 thereof, on the other hand, are substantially coplanar and respectively define a face for the intake of gases into the structure and a face for discharge from the structure.

The connecting joint 203 is, for example, based on ceramic cement, generally consisting of silica and/or silicon carbide and/or aluminium nitride. The filtering units 21 are thus joined together by the joint 203.

As shown in FIG. 5, for each row of adjacent conduits 37, the collecting chambers 61 of the units 21 are interconnected through the joints 203. The collecting chambers 61 of the units 21 defining the lateral faces 33 of the structure 201 emerge into the lateral collectors 65.

The chambers 61 are, for example, formed after the joining-together of the units 21, by ablation through the structure 201 from a lateral face 33 using a laser beam.

Figure 6:
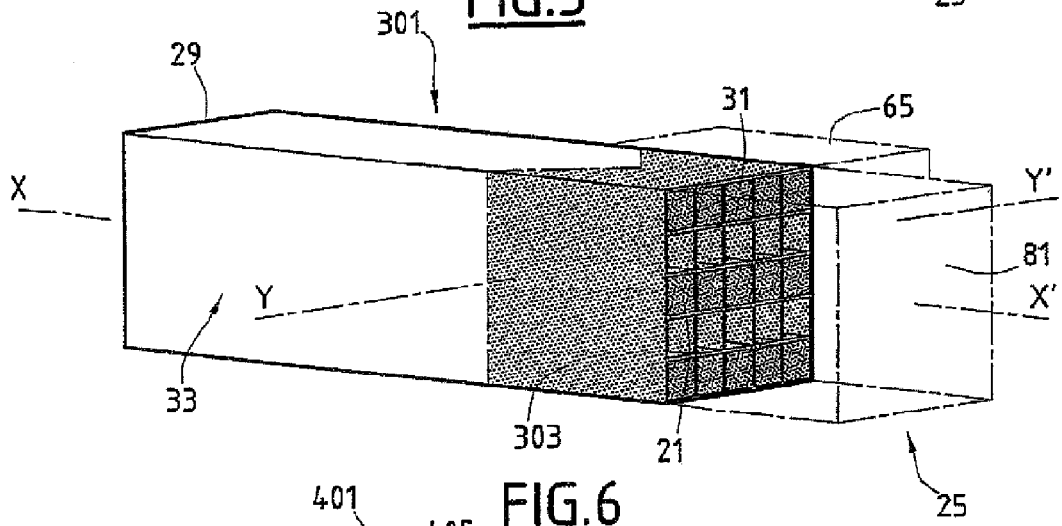
FIG. 6 is a view similar to FIG. 5 of a fourth structure according to the invention.

The fourth structure 301 according to the invention, shown in FIG. 6, differs from the preceding structure merely in terms of the fact that the width, taken parallel to the axis X-X', of the chambers 61, illustrated schematically by a shaded zone 303, decreases from the periphery of the structure 201 toward its centre, along a transverse axis Y-Y'.

Figure 7:
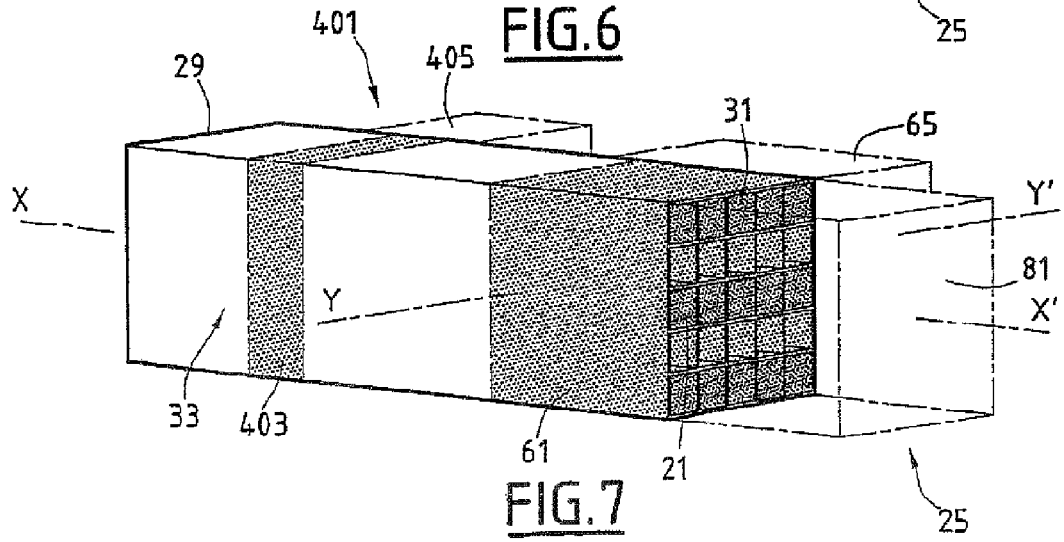
FIG. 7 is a view similar to FIG. 5 of a fifth structure according to the invention.

The fifth structure 401, shown in FIG. 7, is similar to that of FIG. 5. However, secondary chambers for extracting the filtered gases, illustrated schematically by a shaded zone 403, are formed in a median portion of each row of extracting conduits, upstream of the chambers 61. The secondary chambers of each row of conduits are interconnected and those of the units 21 defining the lateral faces 33 of the structure 401 open into secondary collectors 405. The secondary collectors tightly cover the corresponding portions of the vertical lateral faces 33 of the structure 401 and are connected to the collector 17 by a secondary pipe (not shown).

In a variation, the chambers 61 can be distributed over the length of the filtering structure and the lateral collectors 65 can cap the full extent of the lateral faces 33, for example by a horizontal extension of a portion of the exhaust line.

Figure 8:
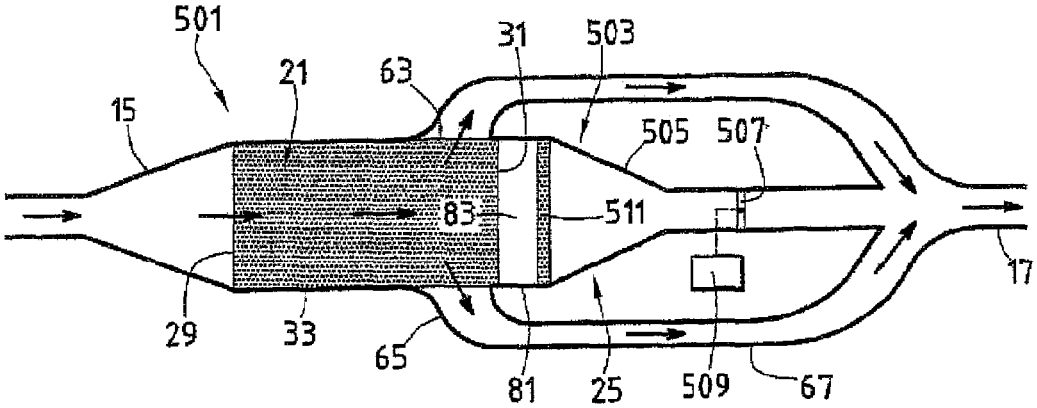
FIG. 8 is a partial cross-section along a horizontal plane of an exhaust line according to the invention comprising a sixth structure according to the invention, during a filtering phase.
Figure 9:
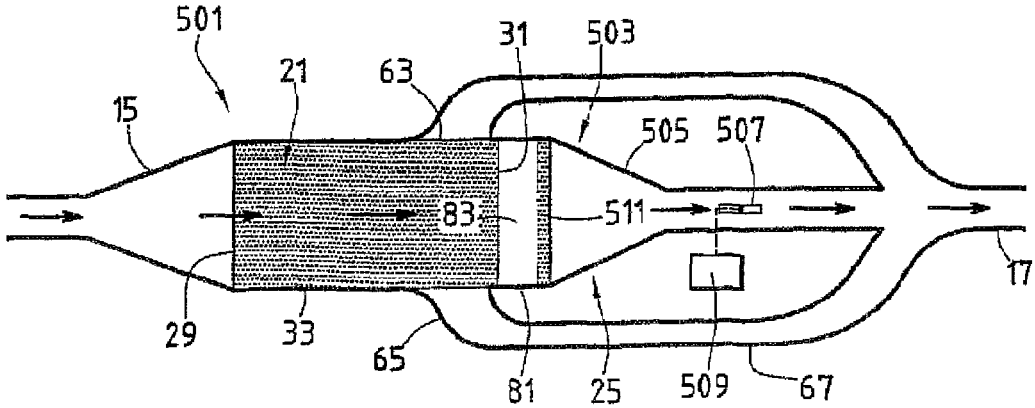
FIG. 9 is a view similar to FIG. 8, during a regeneration phase.

In the sixth structure 501 according to the invention, shown in FIGS. 8 and 9, the residue manifold 25 comprises adjustable exhaust means 503. These means 503 comprise a convergent conduit 505 for producing a connection between the receptacle 81 and the collector 17, a valve 507 for closing this conduit 505, means 509 for controlling the valve 507, and a porous filter 511 interposed between the receptacle 81 and the connecting conduit 505. The filter 511 forms the downstream wall of the receptacle 81.

The porous filter 511 is suitably porous for the loss in pressure induced by the passage of the gases through the unit 21, the receptacle 81, the filter 511 and the collector 25 to be less than the loss in pressure induced by the passage of the gases through the unit 21, the lateral collectors 65 and the pipes 67.

During the filtering phases, the valve 507 is kept closed by the control means 509, so this structure 501 functions in a similar manner to the first structure 11 according to the invention.

During the regeneration phases, the valve 507 is opened by the control means 509. Given the lower loss in pressure induced by the passage of the gases through the unit 21, the receptacle 81, the filter 511 and the collector 25 relative to the loss in pressure induced by the passage of the gases through the unit 21, the lateral collectors 65 and the pipes 67, the exhaust gases preferably flow through the residue discharge openings 49 in the intake conduits 35. They thus penetrate the receptacle 81 and then pass through the filter 511, then through the conduit 505 up to the collector 17. The exhaust gases thus facilitate the migration of the combustion residues accumulated in the intake conduits 35 toward the receptacle 81.

These combustion residues are also retained in the receptacle 81 by the filter 511.

In a variation of the first structure 11, indicated in FIG. 1 by dot-dash lines, the residue manifold 25 comprises means 513 for draining the collected residues. These means consist, for example, of a retractable hatch provided in the lower wall of the receptacle 81.

In another variation (not shown), the residue manifold 25 consists of the upstream portion of the collector 17, in the extension of the face 31. A shutter is arranged in this upstream portion in order to produce the counter-pressure in the intake conduits 35.

Figure 10:
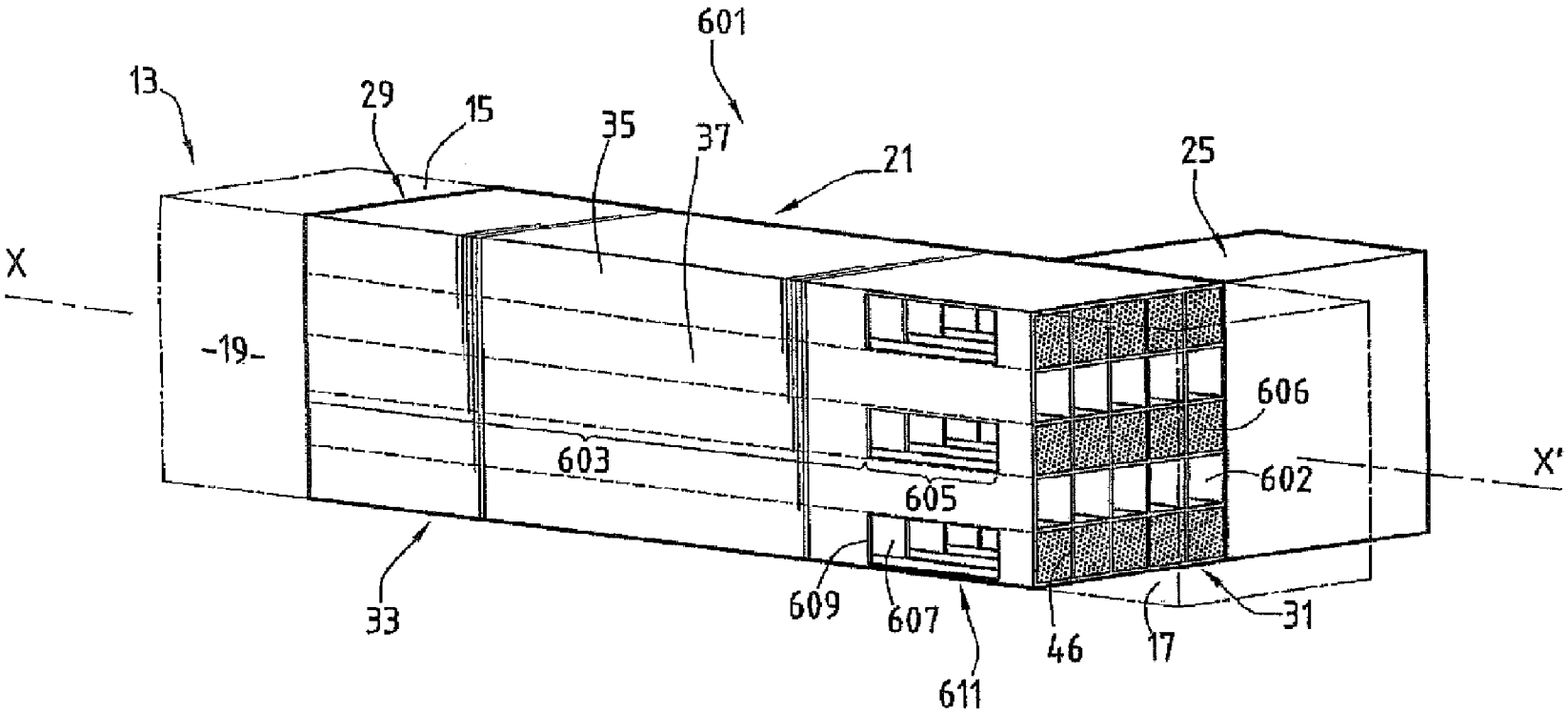
FIG. 10 is a view similar to FIG. 1 of a seventh structure according to the invention.

In the variation 601 of the first structure 11 shown in FIG. 10, each extracting conduit 37 is delimited by continuous walls between the intake face 29 and the discharge face 31. The extracting conduits 37 are closed in the region of the intake face 29 and open in the region of the discharge face 31, through the extracting openings 602.

Moreover, in contrast to the structure 11, each intake conduit 35 comprises an upstream portion 603 and a downstream portion 605 having lateral residue discharge openings 607 formed in the vertical walls 46, in the vicinity of the discharge face 31.

The upstream portion 603 extends continuously between the intake face 29 into which it emerges and the upstream edge 609 of the discharge openings 607.

The downstream portion 605 extends between the upstream portion 603 and the discharge face 31, in the region of which it is closed by an end cap 606.

For each row of intake conduits 35, the lateral openings 607 are arranged facing one another and delimit a transverse residue collecting space 611 which emerges laterally into the lateral faces 33 of the unit 21.

Moreover, the structure 601 comprises two residue manifolds 25 (only one is shown in FIG. 10) arranged facing the lateral faces 33 of the unit 21 and tightly covering the lateral openings 607 which emerge into these faces 33.

Moreover, this structure functions in a similar manner to the first structure according to the invention.

The invention claimed is:

1. A longitudinally extending structure (11; 101; 201; 301; 401; 501; 601) for filtering the exhaust gases from an internal-combustion engine, of the type comprising at least one filtering member (21) comprising:

intake conduits (35) for the gases to be filtered, into which respective gas intake openings (47) emerge, at least some of the intake conduits (35) emerging through openings (49; 607) for discharging respective residues provided downstream of the respective intake openings (47);

extracting conduits (37) for extracting filtered gases emerging into respective openings (55, 63; 602) for extracting filtered gases, the extracting conduits (37) being separated from the intake conduits (35) by porous filtering walls (43);

characterized in that the residue discharge openings (49; 607) of at least one group of intake conduits (35) open into at least one common manifold (25) for receiving solid filtered residues forming counter-pressure means for said group of intake conduits (35), this manifold (25) being isolated from the extracting conduits (37), in that at least some of the openings (55, 63) for extracting filtered gases and/or at least some of the residue discharge openings (607) emerge transversely into the filtering member (21), in that the filtering member (21) comprises rows (39) of adjacent intake conduits (35) and rows (41) of adjacent extracting conduits (37), and in that said intake and extracting conduits extend along axes substantially parallel to a longitudinal axis (X-X') of said structure.

2. Structure (11; 101; 201; 301; 401; 501; 601) according to claim 1, characterized in that the intake conduits (35) are separated from the adjacent extracting conduits (37) by porous filtering walls, the intake conduits (35) are separated from the adjacent intake conduits by structure walls and the extracting conduits (37) are separated from the adjacent extracting conduits (37) by structure walls.

3. Structure (11; 101; 201; 301; 401; 501; 601) according to claim 1, characterized in that, for each row of adjacent intake conduits (35), the residue discharge openings extend facing one another and/or, for each row of adjacent extracting conduits (37), the openings for extracting filtered gases extend facing one another.

4. Structure (11; 101; 201; 301; 401; 501; 601) according to claim 1, characterized in that at least some of the openings for extracting filtered gases (55, 63; 602) extend in the vicinity of the downstream face (31) of the filtering member (21).

5. Structure (401) according to claim 4, characterized in that the extracting conduits (37) emerge into secondary openings (403) for extracting filtered gases that extend in a median portion of the filtering member (21).

6. Structure (101) according to claim 1, characterized in that the intake conduits (35) and the extracting conduits (37) have an elongate cross-section in the transverse direction of the filtering member (21).

7. Structure (501) according to any claim 1 characterized in that the manifold (25) comprises adjustable exhaust means (503).

8. Structure (501) according to claim 7, characterized in that the exhaust means (503) comprise a conduit (505) connecting to an outlet (17) of an exhaust line (13), the conduit (505) being closed by an adjustable valve (507).

9. Structure (11) according to claim 1, characterized in that the manifold (25) comprises means (91) for initiating the burning of soot.

10. Filtering structure (11) according to claim 1, characterized in that the manifold (25) comprises means (513) for draining the collected residues.

11. Exhaust line (13), characterized in that it comprises a structure (11; 101; 201; 301; 401; 501; 601) according to claim 1.

* * * * *